US010056700B2

(12) United States Patent
Kim et al.

(10) Patent No.: US 10,056,700 B2
(45) Date of Patent: Aug. 21, 2018

(54) CIRCULAR ARRAY ANTENNA

(71) Applicants: Electronics and Telecommunications Research Institute, Daejeon (KR); INDUSTRY-ACADEMIC COOPERATION FOUNDATION, CHOSUN UNIVERSITY, Gwangju (KR)

(72) Inventors: Kwang Seon Kim, Daejeon (KR); Sun Soo Oh, Gwangju (KR); Woo Jin Byun, Daejeon (KR); Min Soo Kang, Daejeon (KR); Bong Su Kim, Daejeon (KR)

(73) Assignees: Electronics and Telecommunications Research Institute, Daejeon (KR); INDUSTRY-ACADEMIC COOPERATION FOUNDATION, CHOSUN UNIVERSITY, Gwangju (KR)

( * ) Notice: Subject to any disclaimer, the term of this patent is extended or adjusted under 35 U.S.C. 154(b) by 375 days.

(21) Appl. No.: 14/724,320

(22) Filed: May 28, 2015

(65) Prior Publication Data

US 2015/0357709 A1 Dec. 10, 2015

(30) Foreign Application Priority Data

Jun. 9, 2014 (KR) ..... 10-2014-0069454

(51) Int. Cl.
*H01Q 21/28* (2006.01)
*H01Q 1/38* (2006.01)
(Continued)

(52) U.S. Cl.
CPC ..... *H01Q 21/065* (2013.01)

(58) Field of Classification Search
CPC ..... H01Q 21/065; H01Q 21/29; H01Q 3/24; H01Q 23/00; H01Q 21/0006; H01Q 17/00;
(Continued)

(56) References Cited

U.S. PATENT DOCUMENTS 5,155,495 A * 10/1992 Hately ..... H01Q 9/28 343/725
5,724,042 A * 3/1998 Komatsu ..... G01S 7/032 342/175
(Continued)

FOREIGN PATENT DOCUMENTS

GB 2414863 A * 12/2005 ..... H01Q 21/0006
JP 2414863 A * 12/2005 ..... H01Q 21/0006
(Continued)

*Primary Examiner* — Vladimir Magloire
*Assistant Examiner* — Nuzhat Pervin
(74) *Attorney, Agent, or Firm* — William Park & Associates Ltd.

(57) ABSTRACT

Disclosed is a circular array antenna. The circular array antenna includes: an input/output unit receiving electromagnetic waves from a transmitter and distributing the received electromagnetic waves to the antenna; a primary feeder connected with the input/output unit and placed at the center of the circular array antenna; a plurality of secondary feeders radially connected to the primary feeder; a plurality of patch units connected to the respective secondary feeders to generate an electric field radially; and a plurality of length controllers formed at terminals of the respective secondary feeders in a direction to extend the lengths of the respective secondary feeders, of which the lengths are controllable.

17 Claims, 3 Drawing Sheets

(51) Int. Cl.
*H01Q 21/24* (2006.01)
*H01Q 21/06* (2006.01)

(58) Field of Classification Search
CPC ..... H01Q 1/521; H01Q 1/362; H01Q 1/1207; H01Q 21/28; H01Q 21/00; G01S 21/0056; G01S 21/0062; G01S 7/032; G01S 13/422; G01S 13/02; H04B 5/00
USPC ..... 342/371
See application file for complete search history.

(56) References Cited

U.S. PATENT DOCUMENTS 5,877,726 A * 3/1999 Kudoh ..... H01Q 3/24 342/175
5,977,904 A * 11/1999 Mizuno ..... G01S 13/422 342/70
6,052,086 A * 4/2000 Kudoh ..... H01Q 21/065 343/700 MS
7,095,384 B2 * 8/2006 Koreyasu ..... H01Q 21/0006 343/700 MS
7,250,920 B1 * 7/2007 Steinbrecher ..... H01Q 17/00 343/853
7,511,669 B2 * 3/2009 Maeda ..... H01Q 1/521 343/700 MS
7,944,404 B2 * 5/2011 Yun ..... H01Q 1/362 343/772
8,169,371 B1 * 5/2012 Chamberlain ..... H01Q 1/1207 343/700 MS
8,917,745 B2 * 12/2014 Chen ..... H04L 5/0044 370/468
9,379,437 B1 * 6/2016 Stutzke ..... H01Q 1/28
2010/0225539 A1 * 9/2010 Margomenos ..... G01S 7/032 342/373
2013/0093634 A1 * 4/2013 Rowson ..... H01Q 21/28 343/745
2013/0210348 A1 * 8/2013 Jeon ..... H04B 5/00 455/41.1
2013/0335290 A1 * 12/2013 Desclos ..... H01Q 21/28 343/853
2014/0062823 A1 * 3/2014 Shor ..... H01Q 9/0421 343/816
2014/0232572 A1 * 8/2014 Sharawi ..... G08G 1/123 340/993
2017/0041038 A1 * 2/2017 Kirkpatrick ..... G01S 13/02

FOREIGN PATENT DOCUMENTS

KR 100985048 B1 9/2010
KR 100985048 B1 * 10/2010 ..... H01Q 21/00
KR 100985048 B1 * 10/2010 ..... H01Q 21/00
KR 1020110005258 A 1/2011
WO 2011113542 A1 9/2011

* cited by examiner

CIRCULAR ARRAY ANTENNA

This application claims the benefit of priority of Korean Patent Application No. 10-2014-0069454 filed on 9 Jun. 2014, which is incorporated by reference in its entirety herein.

BACKGROUND OF THE INVENTION

Field of the Invention

The present invention relates to wireless communication, and more particularly, to a circular array antenna.

Discussion of the Related Art

In modern times, a demand for a service that transmits and receives mass data such as video, voice, and the like at a high speed has been rapidly increased. As a result, in recent years, in order to increase a data capacity in a high-speed point-to-point system under a visible distance environment, a research into communication using an orbital angular momentum (OAM) has been actively made worldwide in Sweden, Italia, Japan, Australia, and the like.

The OAM was predicted by Poynting in 1909 and thereafter, introduced in an optical field in 1992 and thus an active research has been in progress. Further, an applicability of the OAM in electromagnetic wave and a microwave fields was presented in 2007.

As a device for generating an OAM mode, a metallic reflection plate and an exciton element are used, but the metallic reflection plate and the exciton element has a form of a 3D structure, and as a result, the metallic reflection plate and the exciton element are influenced by wind or rainfall, snowfall, and the like.

Accordingly, in the technical field, an antenna device not influenced by the wind or the rainfall, the snowfall, and the like is required.

SUMMARY OF THE INVENTION

An object of the present invention is to provide a 2D plane structure antenna generating an orbital angular momentum mode radiation pattern.

Another object of the present invention is to provide an antenna of an orbital angular momentum mode radiation pattern not influenced by wind or rainfall, snowfall, and the like.

In accordance with an embodiment of the present invention, a circular array antenna is provided. The circular array antenna includes: an input/output unit receiving electromagnetic waves from a transmitter and distributing the received electromagnetic waves to the antenna; a primary feeder connected with the input/output unit and placed at the center of the circular array antenna; a plurality of secondary feeders radially connected to the primary feeder; a plurality of patch units connected to the respective secondary feeders to generate an electric field radially; and a plurality of length controllers formed at terminals of the respective secondary feeders in a direction to extend the lengths of the respective secondary feeders, of which the lengths are controllable.

The lengths of the plurality of respective length controllers may be set so that direction of electric field vectors generated in the plurality of patch units are all formed in the same direction.

The circular array antenna may be formed on one same plane.

All of the plurality of secondary feeders may have the same length.

All of the patch units may be connected to the plurality of secondary feeders at the same interval.

The primary feeder may be formed in a ring type of which one side is opened.

The primary feeder may be formed in a triangular shape or a quadrangular shape of which one side is opened.

The patch unit may be formed in a circular shape.

In accordance with another embodiment of the present invention, a circular array antenna is provided. The circular array antenna includes: an input/output unit receiving electromagnetic waves from a transmitter and distributing the received electromagnetic waves to the antenna; a primary feeder connected with the input/output unit and placed at the center of the circular array antenna; a plurality of secondary feeders radially connected to the primary feeder; a plurality of patch units connected to the respective secondary feeders to generate an electric field radially; and a plurality of length controllers formed between the respective secondary feeders and the respective patch units, of which the lengths are controllable.

The lengths of the plurality of respective length controllers may be set so that direction of electric field vectors generated in the plurality of patch units are all formed in the same direction.

The circular array antenna may be formed on one same plane.

All of the plurality of secondary feeders may have the same length.

All of the patch units may be connected to the plurality of secondary feeders at the same interval.

The primary feeder may be formed in a ring type of which one side is opened.

The primary feeder may be formed in a triangular shape or a quadrangular shape of which one side is opened.

The patch unit may be formed in a comb line shape.

The circular array antenna may further include a plurality of connectors formed between the respective length controllers and the respective patch units so that the respective length controls and the respective patch units are separated from each other.

The patch unit may be formed in a square shape.

The patch unit may be formed in any one shape of a rectangular shape, a circular shape, a triangular shape, and a cross shape.

According to the present invention, there is provided a 2D plane structure antenna generating an orbital angular momentum mode radiation pattern not influenced by wind or rainfall, snowfall, and the like.

DETAILED DESCRIPTION OF THE EMBODIMENTS

Figure 1:
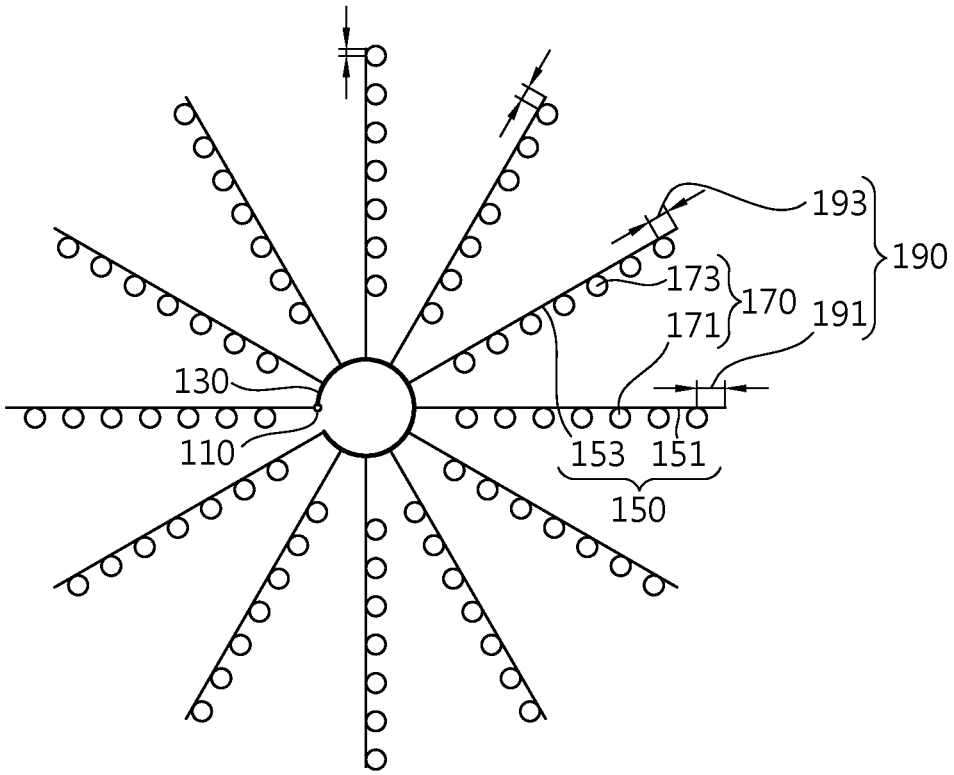
FIG. 1 is a plan view of a circular array antenna according to an embodiment of the present invention.

The present invention will be described more fully hereinafter with reference to the accompanying drawings, in which embodiments of the invention are shown. However, the present invention can be realized in various different forms, and is not limited to the embodiments described herein. Accordingly, the drawings and description are to be regarded as illustrative in nature and not restrictive. Like reference numerals designate like elements throughout the specification.

In the specification, unless explicitly described to the contrary, the word "comprise" and variations such as "comprises" or "comprising", will be understood to imply the inclusion of stated elements but not the exclusion of any other elements. Further, terms including "unit" disclosed in the specification mean a unit that processes at least one function or operation and this may be implemented by hardware or software or a combination of hardware and software.

Hereinafter, an embodiment of the present invention will be described with reference to the accompanying drawings.

FIG. 1 is a plan view of a circular array antenna according to an embodiment of the present invention.

Referring to FIG. 1, the circular array antenna according to the embodiment is configured to include an input/output unit 110, a primary feeder 130, a secondary feeder 150, a patch unit 170, and a length controller 190.

The input/output unit 110 may serve as a passage through an electromagnetic wave generated from a transmitter into an antenna in a transmission mode and serve as a passage through which the electromagnetic wave reaching the antenna is transmitted to a receiver in a reception mode. In the embodiment, a process in which the electromagnetic wave generated from the transmitter is input into the antenna through the input/output unit 110 and a radio wave is emitted will be described. The input/output unit 110 may be directly connected to the primary feeder 130 by using a coaxial cable and indirectly connected by using a slot, and the like.

The primary feeder 130 sequentially distributes the electromagnetic wave input from the input/output unit 110 to the secondary feeder 150 configured by a microstrip line. In the embodiment, the primary feeder 130 is configured in a circular shape, but may be transformed to various shapes such as a triangular shape, a quadrangular shape, and the like for easiness of a design, and the like.

The secondary feeder 150 supplies the electromagnetic wave input from the primary feeder 130 to the patch unit 170. The patch unit 170 receives the electromagnetic wave from the secondary feeder 150 to form a radiation wave. The secondary feeder 150 and the patch unit 170 are together bound to be defined as a sub array. When the electromagnetic wave is supplied to the input/output unit 110, the electromagnetic waves are sequentially supplied to respective secondary feeders 151 and 153 from the primary feeder 130 and the radiation wave is generated through the patch unit 170. In this case, an electric field direction of the generated radiation wave needs to be constant. However, since the sub array constituted by the secondary feeder 153 and the circular patch 173 extends in a different direction from the sub array constituted by the secondary feeder 151 and the patch unit 171, generation direction of the radiation wave are different from each other. Therefore, the length controller 190 which may control the length of the secondary feeder in an extension direction is formed at a terminal of the secondary feeder 150, and as a result, the length may be set so that the directions of the electric fields are the same as each other. When the length of the length controller 191 is ¼ wavelength (λ), the electric field direction of the sub array constituted by the secondary feeder 150 and the patch array may be a y-z direction. However, when the length of the length controller 193 is configured by ¼ wavelength similarly to the length controller 191, the electric field direction of the sub array constituted by the secondary feeder 153 and the patch unit 173 is a direction different from the y-z direction. In this case, the electric field may be formed in the y-z direction by controlling the length of the length controller 193. For example, the electric field may be formed in the y-z direction by controlling the length of a tuning line 191 to be short. The electric field direction may be configured to be formed in the y-z direction by controlling the length of the length controller 190 with respect to all secondary feeders 150 connected to the primary feeder 130. A method for configuring the electric field direction to be the y-z direction has been described in the embodiment, but the electric field directions may be configured to be homogenized as different directions according to the lengths of the length controllers 191 and 193. The patch unit 173 has a circular shape in FIG. 1, but the patch unit 173 may have various shapes such as a ring or a circular slot.

Figure 2:
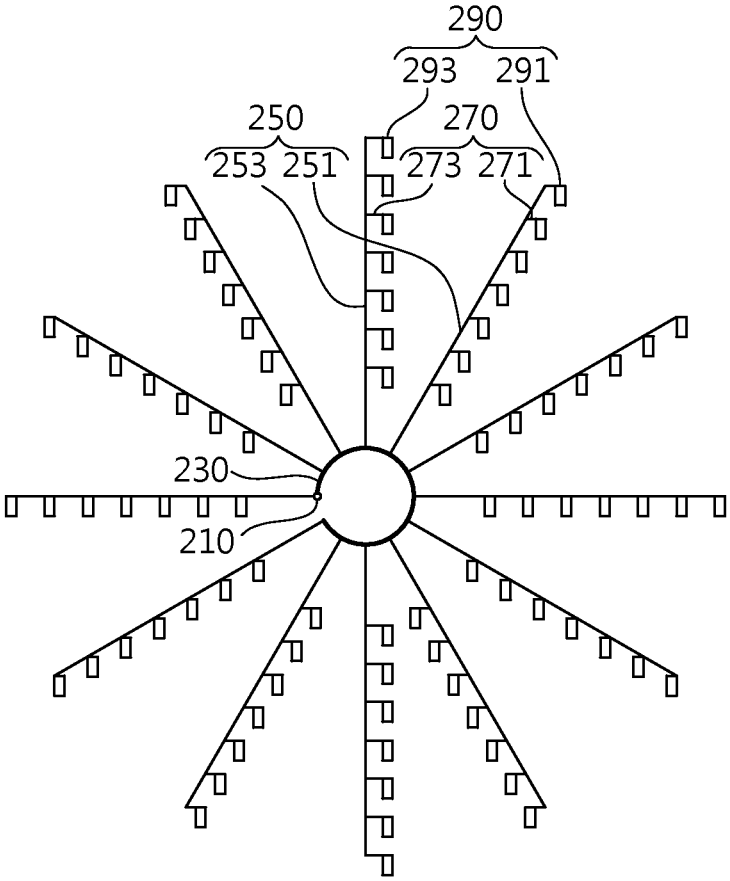
FIG. 2 is a plan view of a circular array antenna according to another embodiment of the present invention.

FIG. 2 is a plan view of a circular array antenna according to another embodiment of the present invention.

Referring to FIG. 2, the circular array antenna according to the embodiment is configured to include an input/output unit 210, a primary feeder 230, a secondary feeder 250, a length controller 270, and a patch unit 290.

The input/output unit 210 may serve as a passage through an electromagnetic wave generated from a transmitter into an antenna in a transmission mode and serve as a passage through which the electromagnetic wave reaching the antenna is transmitted to a receiver in a reception mode. In the embodiment, a process in which the electromagnetic wave generated from the transmitter is input into the antenna through the input/output unit 210 and a radio wave is emitted will be described. The input/output unit 210 may be directly connected to the primary feeder 230 by using a coaxial cable and indirectly connected by using a slot, and the like.

The primary feeder 230 sequentially distributes the electromagnetic wave input from the input/output unit 210 to the secondary feeder 250 configured by a microstrip line. In the embodiment, the primary feeder 230 is configured in a circular shape, but may be transformed to various shapes such as a triangular shape, a quadrangular shape, and the like for easiness of a design, and the like.

The secondary feeder 250 supplies the electromagnetic wave input from the primary feeder 230 to the patch unit 290. The patch unit 290 may generate an orbital angular momentum mode radiation pattern together with the secondary feeder 250. When the electromagnetic wave is supplied to the input/output unit 210, the electromagnetic waves are sequentially supplied to the respective secondary feeders 250 from the primary feeder 230 and the radiation wave is generated through the patch unit 290. In this case, an electric field direction of the generated radiation wave needs to be constant. However, when the electric field direction of the radiation wave generated from the patch unit 291 connected to the secondary feeder 251 is set to a y-z direction, the electric field direction of the radiation wave generated from the patch unit 293 connected to the other secondary feeder 253 is different from the y-z direction. Therefore, the circular array antenna needs to be configured so that the radiation waves generated from the patch unit s290 connected to the respective secondary feeders 250 form the electric field in the same direction. Accordingly, as illustrated in FIG. 2, all electric fields transmitted from a comb line may be set to be generated in the same direction by controlling the length of the length controller 270 between the patch unit 290 and the secondary feeder 250. For example, when the length of the length controller 271 has a predetermined length and the electric field direction of the radiation pattern generated from the patch unit 291 is set to the y-z direction, the electric field direction of the radiation pattern generated from the patch unit 293 may be set to the y-z direction by controlling the length of the length controller 273 to be longer or shorter. A method for configuring the electric field direction to be the y-z direction has been described in the embodiment, but the electric field directions may be configured as different directions according to the length of the length controller 270. The patch unit 290 is formed in the comb line shape in FIG. 2, but the shape of the patch unit 290 may be modified in various shapes.

Figure 3:
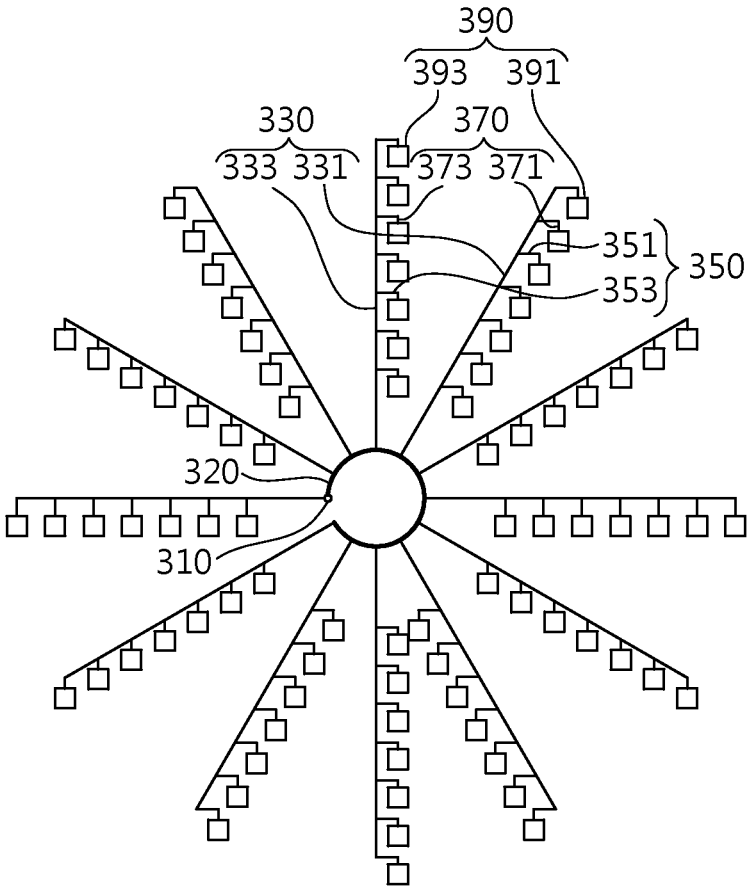
FIG. 3 is a plan view of a circular array antenna according to yet another embodiment of the present invention.

FIG. 3 is a plan view of a circular array antenna according to yet another embodiment of the present invention.

Referring to FIG. 3, the circular array antenna according to the embodiment is configured to include an input/output unit 310, a primary feeder 320, a secondary feeder 330, a length controller 350, and a connector 370.

The input/output unit 310 may serve as a passage through an electromagnetic wave generated from a transmitter into an antenna in a transmission mode and serve as a passage through which the electromagnetic wave reaching the antenna is transmitted to a receiver in a reception mode. In the embodiment, a process in which the electromagnetic wave generated from the transmitter is input into the antenna through the input/output unit 310 and a radio wave is emitted will be described. The input/output unit 310 may be directly connected to the primary feeder 330 by using a coaxial cable and indirectly connected by using a slot, and the like.

The primary feeder 320 sequentially distributes the electromagnetic wave input from the input/output unit 310 to the secondary feeder 330 configured by a microstrip line. In the embodiment, the primary feeder 320 is configured in a circular shape, but may be transformed to various shapes such as a triangular shape, a quadrangular shape, and the like for easiness of a design, and the like.

The secondary feeder 330 supplies the electromagnetic wave input from the primary feeder 320 to the patch unit 390. Similarly to the embodiment of FIG. 2, the circular array antenna according to the embodiment further includes a length controller 350 of which the length is controllable between the secondary feeder 330 and the patch unit 370 so as to constantly maintain the direction of the electric field vector regardless of the direction of the secondary feeder 330. Meanwhile, in the embodiment, the circular array antenna may further include a connector 370 that makes the length controller 350 and the patch unit 390 be separated between the length controller 350 and the patch unit 390.

The patch unit 390 may generate a radiation wave together with the secondary feeder 330. When the electromagnetic wave is supplied to the input/output unit 310, the electromagnetic waves are sequentially supplied to respective secondary feeders 331 and 333 from the primary feeder 320 and the radiation wave is generated through the patch unit 390 via the length controller 350 and the connector 370. In this case, an electric field direction of the generated radiation wave needs to be constant. However, when the electric field direction of the patch unit 391 connected to the secondary feeder 331 is set to the y-z direction, the electric field direction of the patch unit 393 connected to the other secondary feeder 333 is formed as a direction different from the y-z direction. Therefore, the patch units 391 and 393 connected to the respective secondary feeders 331 and 333 need to be set to form the electric field in the same direction. Therefore, electric field vectors forming directions of all radiation waves generated from the patch unit 390 may be set to coincide with each other by controlling the lengths of the length controllers 371 and 373. A method for setting the electric field forming method of the radiation wave to the y-z direction has been described in the embodiment, but the electric field forming direction may be set to be homogenized to a direction different from the y-z direction by configuring the lengths of the length controllers 371 and 373 to be different. The patch unit 390 may have a square shape as illustrated in FIG. 3 and as the patch unit 390, patches having various shapes such as a rectangular shape, a circular shape, a triangular shape, an oval shape, a cross shape, and the like may be used.

Various exemplary embodiments of the present invention have been just exemplarily described, and various changes and modifications may be made by those skilled in the art to which the present invention pertains without departing from the scope and spirit of the present invention. Accordingly, the various embodiments disclosed herein are not intended to limit the technical spirit but describe with the true scope and spirit being indicated by the following claims. The scope of the present invention should be interpreted by the appended claims, and all the technical spirit in the equivalent range should be interpreted to be embraced in the scope of the present invention.

What is claimed is:

1. A circular array antenna comprising:

an input/output unit receiving electromagnetic waves from a transmitter and distributing the received electromagnetic waves to the circular array antenna;

a primary feeder connected with the input/output unit and placed at the center of the circular array antenna;

a plurality of secondary feeders, each of the secondary feeders linearly extending radially from the primary feeder;

a plurality of patch units connected to the respective secondary feeders to generate an electric field radially; and a plurality of length controllers formed at terminals of the respective secondary feeders in a direction to extend the lengths of the respective secondary feeders, of which the lengths are controllable, wherein the circular array antenna generates an orbital angular momentum (OAM) mode radiation pattern, wherein each linearly extending secondary feeder is configured by a microstrip line and supplies the electromagnetic waves input from primary feeder to respective patch units, and wherein the circular array antenna is formed on one same plane.

2. The circular array antenna of claim 1, wherein the lengths of the plurality of respective length controllers are set so that direction of electric field vectors generated in the plurality of patch units are all formed in the same direction.

3. The circular array antenna of claim 1, wherein all of the plurality of secondary feeders have the same length.

4. The circular array antenna of claim 1, wherein all of the patch units are connected to the plurality of secondary feeders at the same interval.

5. The circular array antenna of claim 1, wherein the primary feeder is formed in a ring type of which one side is opened.

6. The circular array antenna of claim 1, wherein the primary feeder is formed in a triangular shape or a quadrangular shape of which one side is opened.

7. The circular array antenna of claim 1, wherein the patch unit is formed in a circular shape.

8. A circular array antenna comprising:

an input/output unit receiving electromagnetic waves from a transmitter and distributing the received electromagnetic waves to the circular array antenna;

a primary feeder connected with the input/output unit and placed at the center of the circular array antenna;

a plurality of secondary feeders, each of the secondary feeders linearly extending radially from the primary feeder;

a plurality of patch units connected to the respective secondary feeders to generate an electric field radially; and a plurality of length controllers formed between the respective secondary feeders and the respective patch units, of which the lengths are controllable, wherein the circular array antenna generates an orbital angular momentum (OAM) mode radiation pattern, wherein each linearly extending secondary feeder is configured by a microstrip line and supplies the electromagnetic waves input from primary feeder to respective patch units, and wherein the circular array antenna is formed on one same plane.

9. The circular array antenna of claim 8, wherein the lengths of the plurality of respective length controllers are set so that direction of electric field vectors generated in the plurality of patch units are all formed in the same direction.

10. The circular array antenna of claim 8, wherein all of the plurality of secondary feeders have the same length.

11. The circular array antenna of claim 8, wherein all of the patch units are connected to the plurality of secondary feeders at the same interval.

12. The circular array antenna of claim 8, wherein the primary feeder is formed in a ring type of which one side is opened.

13. The circular array antenna of claim 8, wherein the primary feeder is formed in a triangular shape or a quadrangular shape of which one side is opened.

14. The circular array antenna of claim 8, wherein the patch unit is formed in a comb line shape.

15. The circular array antenna of claim 8, further comprising: a plurality of connectors formed between the respective length controllers and the respective patch units so that the respective length controls and the respective patch units are separated from each other.

16. The circular array antenna of claim 15, wherein the patch unit is formed in a square shape.

17. The circular array antenna of claim 15, wherein the patch unit is formed in any one shape of a rectangular shape, a circular shape, a triangular shape, and a cross shape.

* * * * *